United States Patent [19]

Berg

[11] 4,404,549

[45] Sep. 13, 1983

[54] LATCHING PORTABLE PERSONAL SECURITY ALARM

[76] Inventor: Richard Berg, 12520 Easton Dr., Saratoga, Calif. 95070

[21] Appl. No.: 262,307

[22] Filed: May 11, 1981

[51] Int. Cl.[3] ..... G08B 15/00

[52] U.S. Cl. ..... 340/574; 340/321; 340/636

[58] Field of Search ..... 340/574, 321, 636

[56] References Cited

U.S. PATENT DOCUMENTS

| | | | |
|---|---|---|---|
| 4,151,520 | 4/1979 | Full | 340/574 |
| 4,213,340 | 7/1980 | Cheng | 340/636 |
| 4,241,332 | 12/1980 | Farque | 340/321 |
| 4,262,180 | 4/1981 | Walter | 340/574 |
| 4,284,982 | 8/1981 | Downey | 340/574 |
| 4,356,481 | 10/1982 | Kuki | 340/636 |

*Primary Examiner*—Glen R. Swann, III

*Attorney, Agent, or Firm*—Jack M. Wiseman

[57] ABSTRACT

Mounted on a housing, which is adapted to be carried on the belt of an operator, is a manually activated alarm switch. In the event of an emergency, the operator activates the alarm switch to set off an alarm contained in the housing. The alarm switch is reset upon release. However, the alarm continues to operate until deactivated by a key switch. Formed in the housing is a suitable key slot for receiving a preselected key. The rotation of the preselected key in the key slot serves to deactivate the alarm.

12 Claims, 5 Drawing Figures

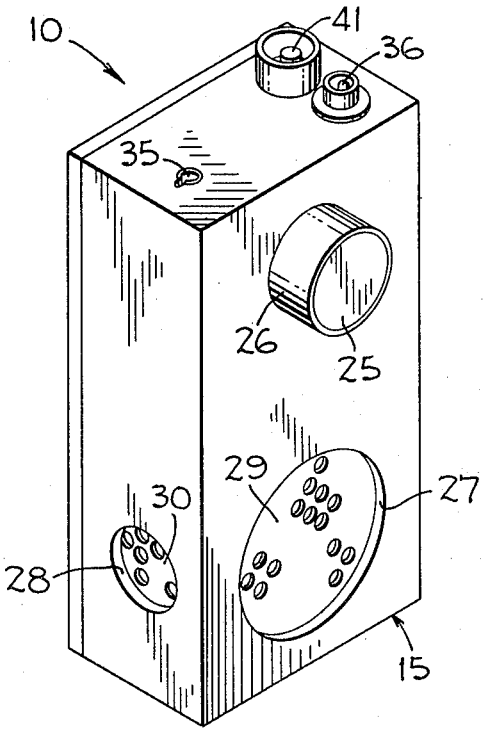
Fig_1
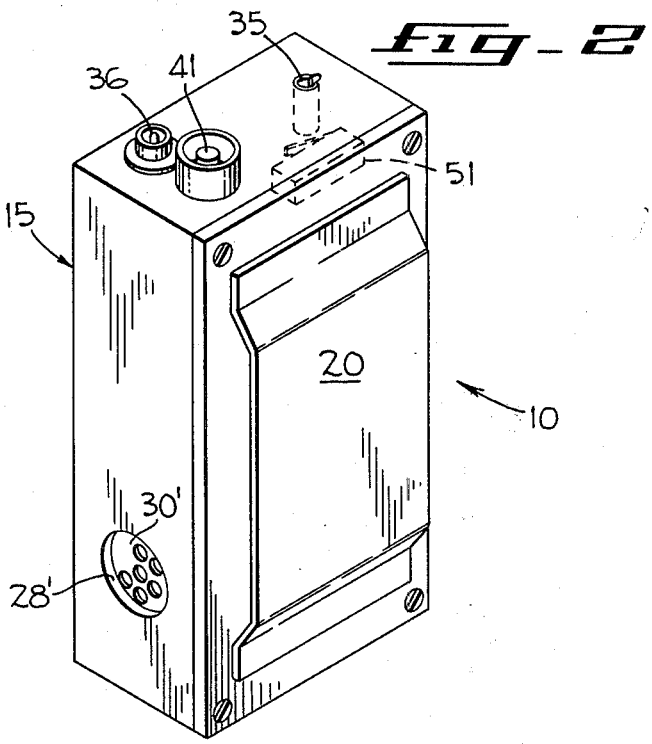
Fig_2
Fig_3
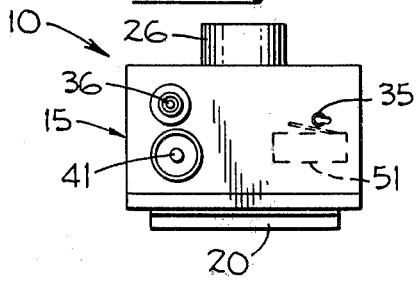
Fig_5
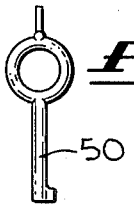
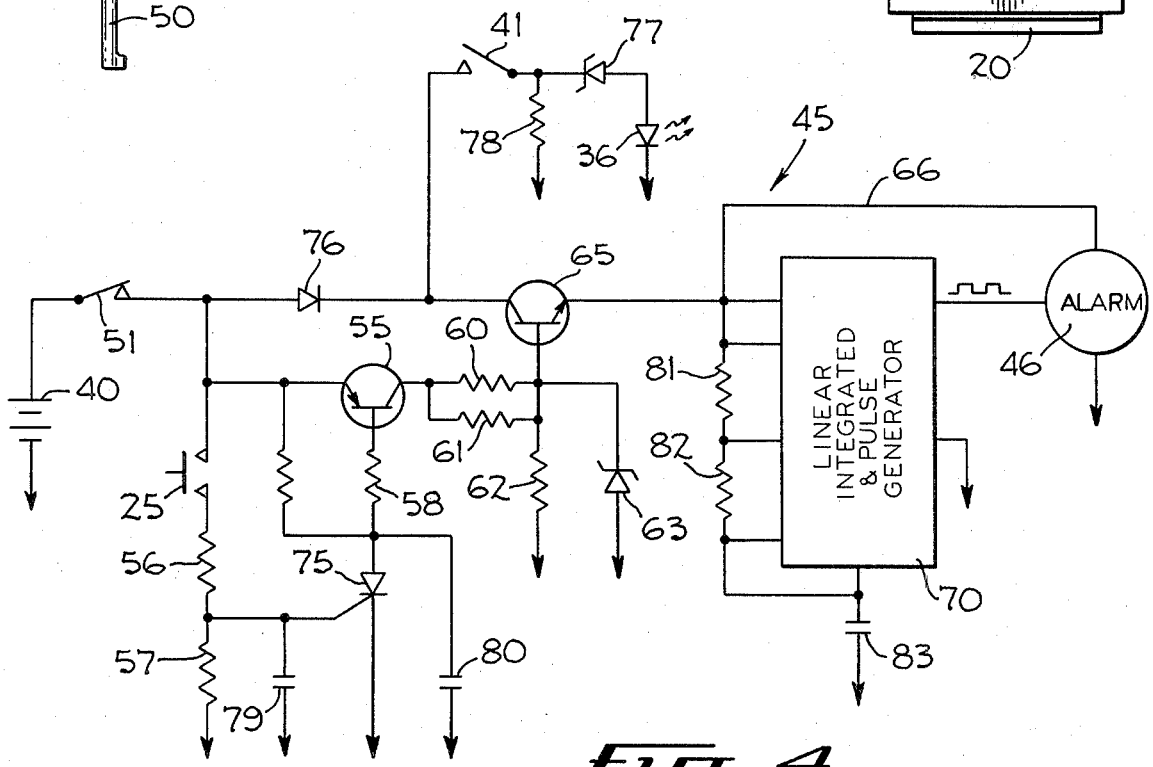
Fig_4

LATCHING PORTABLE PERSONAL SECURITY ALARM

BACKGROUND OF THE INVENTION

The present invention relates in general to alarm devices, and more particularly to a portable alarm device.

Heretofore, personnel in correctional institutions carried portable transmitters and receivers. In other instances, alarm buttons were located on the walls of the corridors within an institution. Shriek alarms have been employed which produced audible alarms through compressed gases. However, such shriek alarms required an operator to actuate continuously the alarm button to produce an alarm signal over an extended time duration. During an emergency condition, the operation of a receiver-transmitter device was not expedient. Also, the ability to maneuver to an alarm button location has not always been possible during an emergency condition.

SUMMARY OF THE INVENTION

A portable alarm device comprises means for attaching the alarm device to the belt or the like of an operator.

An alarm device is carried by an operator and has a manually activated alarm switch on the housing of the alarm device and the alarm device is mounted on the housing.

An alarm device is carried by an operator and has a manually activated alarm switch on the housing of the alarm device and the alarm, once activated, operates continuously over an extended period of time until deactivated by a preselected key received by a key slot in the housing of the alarm device.

The alarm device of the present invention is a reliable, portable, tamper resistant, electronic alarm. It is adapted for use by police, deputy sheriffs and other personnel working in penal, correctional institutions and other institutions of confinement. The alarm device is carried on the person of such personnel. Under emergency conditions, a manually activated switch on the housing of the alarm device is activated to operate an alarm on the housing of the alarm device. The alarm operates continuously until deactivated by the insertion of a standard handcuff key into a key slot and the turning of the handcuff key in the key slot.

DESCRIPTION OF THE DRAWINGS

FIG. 1 is a front perspective view of a portable alarm device embodying the present invention.

FIG. 2 is a rear perspective of the portable alarm device shown in FIG. 1.

FIG. 3 is a top view of the portable alarm device shown in FIGS. 1 and 2.

FIG. 4 is a schematic diagram of an alarm control circuit and alarm embodied in the portable alarm device shown in FIGS. 1–3.

FIG. 5 is a plan view of a key employed to deactivate the alarm of the alarm device shown in FIGS. 1–3.

DESCRIPTION OF THE PREFERRED EMBODIMENT

Illustrated in FIGS. 1–3 is the portable alarm device 10 embodying the present invention. The portable alarm device 10 comprises a suitable housing 15 made of suitable material, such as diecast aluminum or high impact plastic. Means are provided for carrying the alarm device 10 on the person of an operator. In the exemplary embodiment, a plate 20 is mounted on the housing 15 and is employed for attaching the housing 15 to a belt or the like. It is apparent that the plate 20 can also be in the form of a belt clip. Thus, the alarm device 10 is portable and is carried on the person of the operator.

Also mounted on the housing 15 is a manually activated alarm switch, such as a spring loaded push button 25 of a control circuit 45, which, in the exemplary embodiment, is a ARCOLECTRIC switch C936/K. The push button 25 is disposed within a cylindrical sleeve 26 that projects from the housing 15 to prevent accidental actuation. Upon release, the push button 25 is automatically reset under the urgency of the spring thereof. Formed in the housing 15 are suitable openings 27, 28 and 28'. Apertured grill plates 29, 30 and 30' are fixed to the inside walls of the housing 15 confronting the openings 27, 28 and 28', respectively. Thus, sound travels through a front wall and adjacent side walls to reduce the opportunity of inhibiting the impact of a sounding alarm.

At the top of the housing 15 is formed a key slot 35. Mounted on the top of the housing 15 is a well-known light emitting diode 36 of the control circuit 45 employed for checking the power supply. The power supply, in the exemplary embodiment, comprises two standard 9 volt batteries 40 of the type sold by Mallory as MN 1604 alkaline batteries. Also, disposed on the top of the housing 15 is a power supply check switch 41. In the exemplary embodiment, the power supply check switch 41 is an ALCO switch MSP-103C-B. The switch 41 and the batteries 40 are part of the control circuit 45.

Illustrated in FIG. 4 is the control circuit 45 for controlling the operation of a suitable alarm 46. The alarm 46 is mounted on or within the housing 15. In the exemplary embodiment, the alarm 46 is a horn alarm manufactured by Star Micronics of New York, New York, Model SDB 09TS.

The push button 25 is an alarm activating switch that is normally open. It is spring loaded and upon release assumes automatically a reset state. When the push button 25 is actuated to close the contacts thereof, a silicon controlled rectifier 75 conducts from the application of a positive going pulse on its gate electrode over the following path: batteries 40, switch 51, switch 25, 10K ohm resistor 56, 3K ohm resistor 57 and ground. The silicon controlled rectifier 75 is, in the exemplary embodiment, a Motorola 2N5061. Capacitors 79 and 80 are filter capacitors to prevent noise, such as r.f. noise on start-up surges of current, from turning on or falsely operating the silicon controlled rectifier 75. Current now flows in the circuit of the base electrode of a transistor 55 through a 3K ohm resistor 58, silicon controlled rectifier 75 and ground. The conduction of the transistor 55 causes current to flow from its collector electrode through parallel resistors 60 and 61 of 150 ohms, respectively, and parallel paths including a 30K ohm resistor 62 and Zener diode 63. The transistor 55, in the exemplary embodiment, is a Motorola 2N 5061 transistor.

The conduction of the transistor 55 causes a transistor 65 to turn on or conduct. In the exemplary embodiment, the transistor 65 is a Motorola MPSU01A. The base electrode of the switching and voltage regulating transistor 65 is connected to a junction between the resistor 62 and the Zener diode 63. There is a continuous flow of current in the circuit of the base electrode of the transistor 65, when the transistor 55 conducts, to cause the transistor 65 to conduct.

The conduction of the transistor 65 activates the alarm 46 over a conductor 66 and also activates a linear integrated and pulse generator circuit 70. The linear integrated and pulse generator circuit 70 is a Signetics NE 555N integrated circuit. The output of the pulse generator 70 is in the form of square wave pulses that maintain the operation of the alarm 46. Resistors 81 and 82 and capacitor 83 select the pulse rate at which the alarm 46 is turned on and off. The alarm 46 produces a pulsating sound of 85–90 db at a ten foot distance. The alarm 46 will operate continuously until deactivated.

While the transistor 55 conducts, there is a continuous flow of current in the circuit of the base electrode of the transistor 65 to maintain the transistor 65 in a conductive state. The conduction of the silicon controlled rectifier 75 maintains the transistor 55 in a conductive state by maintaining a continuous current flow in the circuit of the base electrode of the transistor 55 to perform a latch operation. Thus, the push button 25 is immediately reset for opening its contacts through the action of its spring. Although the push button 25 is immediately reset, the conduction of the silicon controlled rectifier 75 performs a latch operation to maintain the transistor 55 in a conductive state. The continuous conduction of the transistor 55 maintains the transistor 65 in a continuous conductive state. Hence, the linear integrated and pulse generating circuit 70 operates continuously to continuously operate the alarm 46 until the control circuit 45 is deactivated.

In order to deactivate the control circuit 45, an alarm deactivating switch 51 is opened. The opening of the alarm deactivating switch 51 removes the power supply or batteries from all the active elements of the control circuit 45. The opening and closing of the alarm deactivating switch 51, in the preferred embodiment, is achieved through a preselected key 50 (FIG. 5). In the preferred embodiment, the key 50 is of the type used by law enforcement agencies for the unlocking of manacles. The deactivating switch 51 is a well-known microswitch that is normally closed. Turning the key 50 in the key slot 35 in either direction opens the alarm deactivating switch 51 to remove the power supply or batteries from the active elements of the control circuit 45. Turning the key 50 in the key slot 35 in the opposite direction closes the alarm deactivating switch 51 to enable the control circuit 45 to be prepared for operating the alarm 46 upon the actuation of the push button 25.

For testing periodically the output of the batteries 40, the switch 41 is closed. When the batteries 40 produce the desired voltage output, the light emitting diode 36 is illuminated over the following path: batteries 40, switch 51, diode 76, switch 41, Zener diode 77, light emitting diode 36 and ground. The opening of the switch 41 extinguishes the light emitting diode 36. If the batteries 40 were not producing the desired voltage output, the light emitting diode 36 would not be illuminated upon the closing of the switch 41. A load resistor 78 simulates the loading effect of the circuitry and alarm 46 so that the terminal voltage of the batteries 40 is checked under operating conditions.

I claim:

1. A portable alarm device comprising:
(a) a housing;
(b) means on said housing for supporting said housing on the person of an operator;
(c) an alarm on said housing; and
(d) a control circuit in said housing for controlling the operation of said alarm,
(e) said control circuit including a manually actuable switch on said housing to activate said control circuit for operating said alarm, said control circuit once activated continuously operates said alarm until said control circuit is deactivated, said control circuit including an alarm deactivating switch on said housing manually actuable to deactivate said control circuit for discontinuing the operation of said alarm.

2. A portable alarm device as claimed in claim 1 wherein said housing includes a key slot, said portable alarm further comprising a key insertable in said key slot, movement of said key in said key slot actuating said alarm deactivating switch for deactivating said control circuit and movement of said key in said key slot actuating said alarm deactivating switch to enable said control circuit for activation by said manually actuable switch.

3. A portable alarm device as claimed in claim 2 wherein said manually actuable switch is spring loaded to reset said manually actuable switch upon release by an operator.

4. A portable alarm device as claimed in claim 3 wherein said means is a fixedly secured attachment forming a loop to receive a belt worn by an operator.

5. A portable alarm device as claimed in claim 3 wherein said manually actuable switch is a push button switch disposed within a sleeve that projects from said housing to inhibit accidental actuation.

6. A portable alarm device as claimed in claim 1 wherein said control circuit includes an indicator on said housing, a source of power in said housing, a power test switch on said housing, and a power test circuit interconnecting said source of power, said power test switch and said indicator for activating said indicator in response to the actuation of said power test switch when the voltage output of said source of power is of a preselected magnitude.

7. A portable alarm device as claimed in claim 6 wherein said power test circuit includes load means to simulate the actual load for said source of power during a power test operation.

8. A portable alarm device as claimed in claim 7 wherein said power test circuit includes load means to simulate the actual load for said source of power during a power test operation.

9. A portable alarm device comprising:
(a) a housing;
(b) an alarm on said housing; and
(c) a control circuit in said housing for controlling the operation of said alarm,
(d) said control circuit including a manually actuable switch on said housing to activate said control circuit for operating said alarm,
(e) said control circuit including means to operate said alarm continuously once said control circuit is activated by said manually actuable switch until said control circuit is deactivated,
(f) said control circuit including an alarm deactivating switch on said housing manually actuable to deactivate said control circuit for discontinuing the operation of said alarm.

10. A portable alarm device as claimed in claim 9 wherein said housing includes a key slot, said portable alarm further comprising a key insertable in said key slot, movement of said key in said key slot actuating said alarm deactivating switch for deactivating said control circuit and movement of said key in said key slot actuating said alarm deactivating switch to enable said control circuit for activation by said manually actuable switch.

11. A portable alarm device as claimed in claim 10 wheren said manually actuable switch is spring loaded to reset said manually actuable switch upon release by a operator.

12. A portable alarm device as claimed in claim 9 wherein said control circuit includes an indicator on said housing, a source of power in said housing, a power test switch on said housing, and a power test circuit interconnecting said source of power, said power test switch and said indicator for activating said indicator in response to the actuation of said power test switch when the voltage output of said source of power is of a preselected magnitude.

* * * * *